United States Patent [19]

Huber et al.

[11] 4,186,664

[45] Feb. 5, 1980

[54] SMOKE PROJECTILE CHARGE AND PROCESS FOR ITS MANUFACTURE

[76] Inventors: Paul Huber, Haus Nr. 9, 8234 Unterjettenberg; Alois Schiessl, Hochfeldstrasse 26, 8231 Weissbach-Marzoll; Hartmut Krone, Bertholdstrasse 4, 7844 Neuenburg, all of Fed. Rep. of Germany

[21] Appl. No.: 752,637

[22] Filed: Dec. 8, 1976

[30] Foreign Application Priority Data

Dec. 9, 1975 [DE] Fed. Rep. of Germany ..... 2555323

[51] Int. Cl.[2] ..... F42B 13/14; C06B 33/02

[52] U.S. Cl. ..... 102/66; 102/90; 149/44

[58] Field of Search ..... 102/66, 6, 65, 90; 149/37, 44, 108.2, 108.6

[56] References Cited

U.S. PATENT DOCUMENTS

| | | | |
|---|---|---|---|
| 1,279,422 | 9/1918 | Peterson | 102/6 |
| 1,960,591 | 5/1934 | Nash | 149/37 |
| 2,749,226 | 6/1956 | Lewis | 149/37 |
| 2,792,294 | 5/1957 | McLain | 149/37 |
| 3,625,855 | 12/1971 | Douda | 149/37 |
| 4,002,121 | 1/1977 | Prochnow | 102/66 |
| 4,043,268 | 8/1977 | Fischer | 102/90 |

FOREIGN PATENT DOCUMENTS

| | | | |
|---|---|---|---|
| 2525553 | 12/1976 | Fed. Rep. of Germany | 102/66 |
| 2531365 | 2/1977 | Fed. Rep. of Germany | 102/66 |
| 411540 | 8/1945 | Italy | 102/66 |
| 259539 | 7/1926 | United Kingdom | 102/66 |

*Primary Examiner*—Samuel W. Engle
*Assistant Examiner*—Donald P. Walsh
*Attorney, Agent, or Firm*—Kenway & Jenney

[57] ABSTRACT

This invention relates to a shell filling comprising smoke pots which are stacked one above the other in the firing direction in the shell casing and which consist of a closed metal housing and, accommodated therein, a smoke charge based on hexachloroethane, zinc oxide and metal powder, and to a process for producing smoke pots for shell fillings of this type.

7 Claims, 3 Drawing Figures

SMOKE PROJECTILE CHARGE AND PROCESS FOR ITS MANUFACTURE

BACKGROUND

Smoke pots containing smoke charges based on hexachloroethane, zinc oxide and metal powder are used for a variety of different types of ammunition. In general, the smoke pots are not very highly compressed. However, certain types of ammunition which have recently appeared are exposed to such high accelerations on firing that conventional smoke pots of this type cannot be used, because tests have shown that the housings of the smoke pots are deformed by the high acceleration on firing to such an extent that the smoke pots can no longer be ejected from the shell casing. This is understandable when it is considered that, for an acceleration on firing of, for example, 18,000 g, considerable forces act on the housing of the smoke pots and particularly on the housing of the lowermost smoke pot. In addition, however, it has been found that the reaction time of smoke pots such as these is no longer reproducible either. This is explained by the fact that the reaction velocity is dependent upon the compression of the smoke charge and uncontrollable compression effects occur at the acceleration levels referred to above.

Accordingly, the object of the present invention is to provide a smoke shell filling and a process for its production, which is able to withstand extremely high accelerations on firing, for example of the order of 18,000 g, and which is comparable with conventional smoke shells for comparatively low accelerations on firing in regard to its smoke effect, stability in storage and manufacturing costs, but superior in regard to its reaction time.

According to the invention, this object is achieved by virtue of the fact that the smoke pots lie one on top of the other in complete surface contact, by virtue of the fact that the components of each pot housing consist of the same material, the load-bearing components being equal in strength, and by virtue of the fact that the smoke changes completely fill the housing and are self-supporting in themselves. In this way, an uninterrupted structure is obtained both for the stack of pots as a whole and for the individual smoke pots, the self-supporting smoke charges making a considerable contribution towards stability.

Shell fillings of the type in question normally consist of smoke pots of which the housings consist of two coaxial tubes which between them form an annular chamber for the smoke charge, the annular chamber being covered on both sides by annular covers. According to the present invention, the smoke pot housings are preferably designed in such a way that, at both ends, the outer tube comprises a projecting annular rim of reduced wall thickness, the annular rim is set back in relation to the annular chamber to form an annular shoulder in alignment with the end face of the inner tube and is formed with a screwthread on that surface which faces the annular chamber, and the annular covers are provided on their outer edge with a screwthread corresponding to the screwthread on the annular rim of the outer tube and are screwed into the outer tube with such countersinking that the surfaces of the covers are flush with the end faces of the annular rims and the inner surfaces of the covers rest, on the one hand, on the annular shoulders of the outer tube and, on the other hand, on the end faces of the inner tube. In order to show self-supporting properties, the smoke charge which completely fills the annular chamber is highly compressed, preferably under a pressure of 1300 kp/cm$^2$.

The production of the smoke pots according to the invention with a highly compressed and, hence, self-supporting smoke charge has revealed a problem which was not previously known in smoke charges of the same composition, namely that the highly compressed smoke charges show low stability in storage which, in the extreme case, can result in complete failure of the ammunition. According to the invention, these difficulties are obviated by a process for producing the smoke pots with highly compressed smoke charges, wherein the zinc oxide is calcined at at least 900° C. before being mixed with the other components of the smoke charge. For reasons which will be explained hereinafter, this treatment makes the smoke charges extremely stable in storage, in other words their stability in storage is at least equivalent to that of non-compressed or lightly compressed smoke charges.

Further details of the invention will become apparent from the following description, the accompanying drawings and the claims. In the accompanying drawings, which show one example of embodiment of the smoke pot according to the invention:

Figure 1:
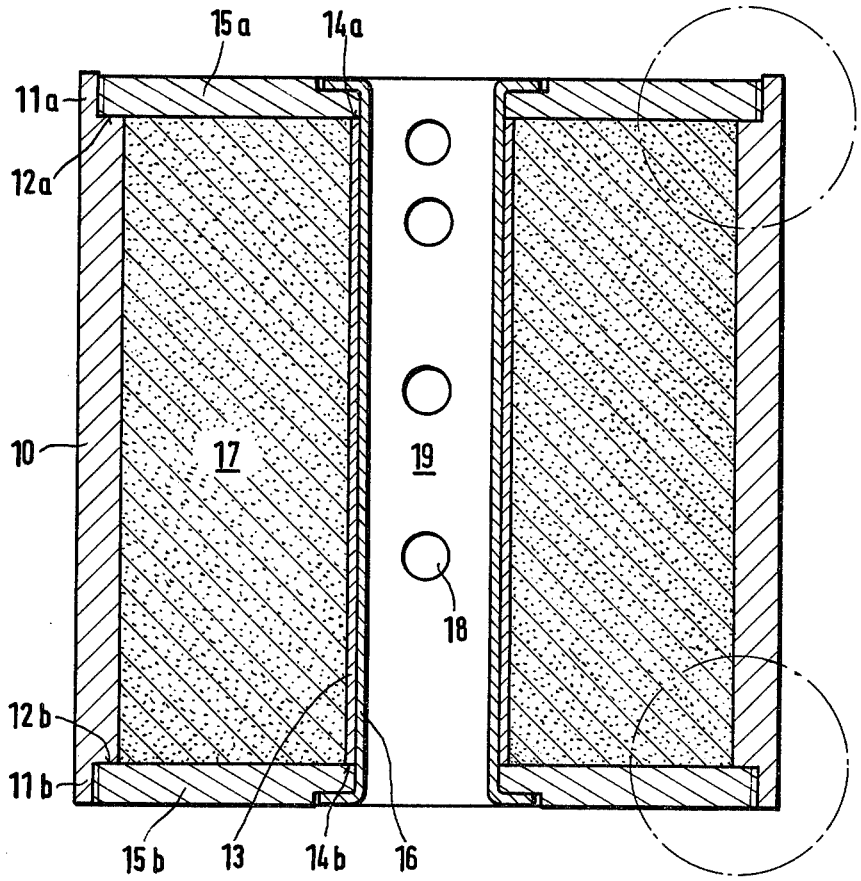
FIG. 1 is a longitudinal section through the smoke pot.

According to FIG. 1, the smoke pot comprises an outer tube 10 provided at both ends with an annular rim 11*a*, 11*b* of reduced wall thickness. The references 12*a*, 12*b* denote the annular shoulder formed by the reduced wall thickness of the annular rim. Disposed coaxially inside the outer tube 10 is an inner tube 13 of which the edges 14*a*, 14*b* align with the annular shoulders 12*a*, 12*b*. The references 15*a* and 15*b* denote two annular covers which are formed on their outer edges with screwthreads which correspond with screwthreads formed on the inner surfaces of the annular rims 11*a*, 11*b*. A retaining tube 16 fits into the inner tube 13, being flanged into recesses in the annular covers 15*a*, 15*b* to surround them at both ends. The annular chamber between the outer tube 10 and the inner tube 13 is filled with a smoke charge 17 which communicates through openings 18 in the inner tube 13 and the retaining tube 16 with the interior 19 of these tubes, the so-called degassing channel.

In the production process, one of the annular covers, for example the annular cover 15*b*, is first of all screwed into the outer tube 10 until it rests on the annular shoulder 12*b* of the outer tube and the end face 14*b* of the inner tube 13. The retaining tube 16 is then flanged and the projecting part of the outer tube and, optionally, of the retaining tube is squared off with the screwed-in cover 15*b*. In this way, a bearing surface is formed in the vertical plane, corresponding to the entire wall thickness of the outer tube 10 and the inner tube 13. A pressure acting on the smoke pot is thus uniformly absorbed by the entire supporting surface. The smoke charge 17 is pressed into this supporting structure, consisting of the outer tube 10, the inner tube 13 and the annular cover 15*b*, under a pressure of 1300 kp/cm$^2$ exactly to the level of the annular shoulder 12*a* of the outer tube 10 and the end face 14*a* of the inner tube 13. The projecting, compressed charge is optionally further compressed and squared off to the necessary level. Finally, the annular cover 15*a* is screwed into the outer tube 10 until, like the annular cover 15*b*, it rests on the annular shoulder 12*a* and the end face 14*a*, after which the retaining tube 16 is flanged and the projecting part of the outer tube 10 is squared off with the screwed-in cover 15*a*.

In this way, the smoke charge forms a substantially self-supporting element of the smoke pot and enables the wall thicknesses of the housing to be kept comparatively thin. For the same volume of the smoke pot, it is possible to introduce more smoke charge than in the case of smoke pots where the metal housing is the sole supporting element. For reasons of specific strength, weight and cost, highstrength aluminium is the most suitable material for the housing.

Figure 2:
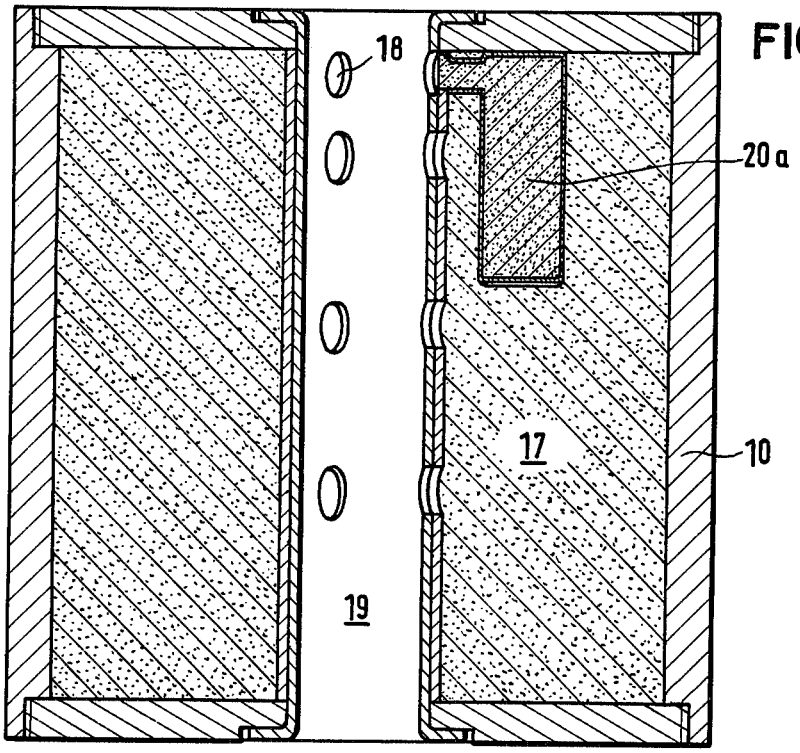
FIG. 2 is a longitudinal section through the smoke pot with its ignition charge.
Figure 3:
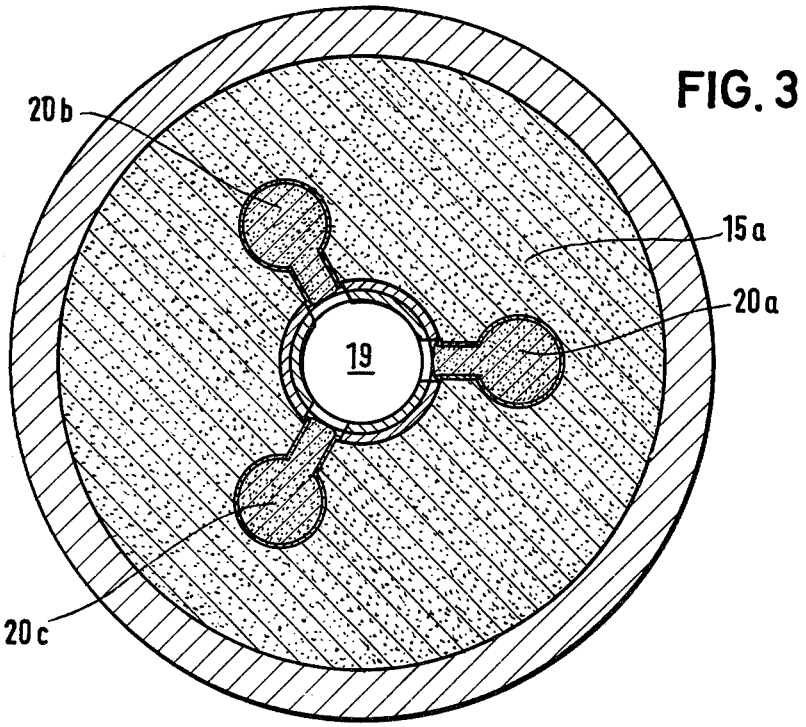
FIG. 3 is a plan view of the smoke pot illustrated in FIG. 2.

It is of course necessary to incorporate an ignition system in the smoke pot. The smoke charge and the ignition system are compressed together to form a uniformly compressed block under such a high pressure that no further deformation can occur under a load of 18,000 g. FIGS. 2 and 3 show one example of an ignition system of this type which consists of three ignition tubes 20*a*, 20*b* and 20*c* which are embedded in the smoke charge. The number of ignition tubes, their size, the structure of the ignition charge and its position in the smoke charge play an important part. On the one hand, they have to extend as far as possible into the smoke charge 17 to ensure satisfactory heat transfer and hence safe initiation of the smoke-forming reaction, whilst on the other hand they have to be situated so closely to the degassing channel 19 that an outwardly directed opening is formed in time to allow the gaseous active smoke ingredient to escape. At the same time, this degassing opening forms the necessary space for the actual smoke-forming reaction, which is known to occur in the gas phase, to take place. The formation in good time of an opening to the degassing channel and, hence, the creation of the empty space are important because otherwise the housing could either be explosively split open by the gas pressure generated during the reaction, thereby terminating the smoke-forming reaction, or alternatively the reaction of the smoke might not start at all on account of the missing gas space. It has been found that the optimum distance from the ignition cartridges 20 to the degassing channel 19 amounts to between 5 and 10 mm and preferably to 7 mm.

The composition of the ignition charge of the ignition cartridges must be such that, on the one hand, the thermal energy is sufficient to initiate the smoke charge 17 but, on the other hand, is not so intense as to cause explosive initiation of the smoke-forming reaction, in which case the housing would no longer withstand the sudden increase in gas pressure. Accordingly, the reaction temperature of the ignition charge must lie in a certain temperature range. In addition, the ignition charge must flux very quickly on burning up to ensure that it is not forced outwards under the effect of centrifugal force (rotation 16,000 rpm), as a result of which it could again result in overviolent initiation of the smoke charge 17. According to the invention, this problem is solved by using a reaction mixture of $Si/Pb_3O_4$ in a ratio of about 30:70.

As already mentioned, it has been found in practice that highly compressed smoke charges based on hexachloroethane, zinc oxide and metal powder, of the type that have to be used here, give rise to difficulties which were previously unknown in smoke charges of the same composition. This is because, when these smoke charges are highly compressed, they show poor stability in storage which, in the extreme case, can result in complete failure of the ammunition. This instability is attributable to the water content of the smoke charge, this water content being much more harmful to highly compressed smoke charges than to the conventional smoke charges of comparatively low compression. Accordingly, an attempt was initially made to eliminate the instability of the highly compressed smoke charge by drying the final smoke mixture at temperatures above 100° C. However, the desired result was not obtained because, during its further processing (compression, filling), the smoke charge reabsorbs most of its original water content. It was not possible, even by further processing the dried smoke charges in air-conditioned atmospheres, reliably to eliminate the instability of the smoke charge in storage.

Exhaustive tests have now shown that the stability of a smoke charge in storage is primarily determined by its zinc chloride content. Part of this chloride is actually introduced into the smoke mixture as an impurity of this zinc oxide, and part is formed during pressing of the smoke charge. Zinc chloride is highly hygroscopic and, hence, is responsible for the fact that, even when produced from predried chemicals, smoke charges very quickly absorb moisture from the air and, accordingly, cannot be effectively processed under high pressures.

Now, the process according to the invention seeks to eliminate the presence of and the formation of zinc chloride during production of the smoke charge. According to the invention, this result is achieved by calcining the zinc oxide at at least 900° C. before it is mixed with the other components of the smoke charge. This calcining treatment has a two-fold effect. Firstly, the zinc oxide contaminated by hygrosopic zinc chloride is purified through volatilisation of the zinc chloride, so that it loses it hygroscopic effect. Secondly, no more chloride is formed during pressing of a dry charge. Accordingly, the compressed smoke charge also shows no further tendency to absorb water. Thus, it was not possible to detect any chloride, for example in a smoke charge produced with calcined zinc oxide, even after storage for 5 months. By contrast, a smoke charge of the same recipe, produced from non-calcined zinc oxide, was found to contain 1.3% of zinc chloride after only 2 days. In consistency with these findings, there had been no change in the reaction time of the first, calcined charge over the 5-month storage period, whereas in the case of the second, non-calcined smoke charge, the reaction could no longer be initiated after only a few weeks. Accordingly, it is possible in the process according to the invention to start with the known basic components in their standard commercial-grade form. In general, there is no need to pretreat the hexachloroethane and the metal powder because standard commercial-grade hexachloroethane and metal powder are substantially anhydrous and free from hygroscopic impurities. By contrast, the zinc oxide contains highly hygroscopic impurities, above all zinc chloride and zinc sulphate. These impurities are now removed by heating the zinc oxide to a temperature above 900° C. (calcination). After this calcining treatment, the three components of the smoke charge may be mixed together in the usual way. The mixture is then compressed under a pressure of at least 1300 kp/cm$^2$. Tests have shown that the smoke charges produced in this way are extremely stable in storage. In addition, the process according to the invention affords the possibility of using zinc oxide which, as a result of incorrect or poor storage, no longer appears suitable for normal mixtures. Similarly, even extremely moist zinc oxide can be made re-useable by calcination before use.

Instead of using standard commercial-grade zinc oxide, it is also possible to use zinc oxide which ab initio is free from hygroscopic impurities providing it has the necessary reactivity. In this case, there is no need for the calcining treatment.

Smoke charges based on hexachloroethane and zinc oxide additionally contain a proportion of metal powder as reaction accelerator. Of the powders normally used for this purpose, aluminium powder is particularly suitable in the present case because the housing material also consists of aluminium. This standardisation precludes the formation of local elements and, hence, reciprocal corrosive destruction.

The formation of chloride is also a measure of the passivation of a smoke charge. By virtue of the fact that it does not occur in cases where calcined charges are used, the proportion of metal powder can be reduced by half in comparison with charges that are not completely dry. Since the aluminium not only contributes towards smoke formation, but also increases the residue, the smoke yield is also considerably increased by the present invention.

In one example of embodiment where the primary object was to obtain the longest possible smoking times, a smoking time of 3.5 minutes was obtained for a filling weight of 2.2 kg using the following recipe:

47.25% of ZnO (calcined)
47.25% of hexachloroethane
5.50% of aluminium powder.

If non-calcined zinc oxide were to be used, an aluminium powder content of at most 10 to 11% would be required to obtain the same smoking time.

What we claim is:

1. A shell filling of smoke pots which are stacked one above the other in the firing direction in the shell casing and which comprise a closed metal housing comprising a smoke charge completely filling the housing, the smoke charge being formed by high compression under a pressure of at least 1300 kp/cm$^2$, whereby the compressed smoke charge contributes substantially to the support of the above-stacked charges and provides a self-supporting smoke charge structure, wherein the smoke charge incorporates an ignition charge, the smoke charge and the ignition charge being compressed together to form a common block of uniform compression, and wherein the smoke charge comprises a chlorinated organic compound, zinc oxide and metal powder, the zinc oxide being calcined at at least 900° C. before being mixed with other components of the smoke charge, whereby the smoke charge possesses enhanced storage stability.

2. A filling according to claim 1, wherein the smoke charge comprises hexachloroethane, zinc oxide and metal powder.

3. A filling according to claim 1, wherein the ignition charge comprises a mixture of silicon and lead oxide ($Pb_3O_4$) in a ratio of 30:70.

4. A filling according to claim 1, wherein the ignition charge consists of three ignition cartridges which are embedded in the smoke charge symmetrically to the central axis of the smoke pot, the distance between each ignition cartridge and the inner tube amounting to between 5 to 10 mm and preferably to 7 mm.

5. A filling according to claim 1 wherein the housing consists of two coaxial tubes which between them form an annular chamber for the smoke charge, the annular chamber being covered on both sides by annular covers, wherein the outer tube is screwed at both ends to the annular covers, the outer tube comprising at both ends a projecting annular rim of reduced wall thickness, the annular rim is set back in relation the annular chamber to form an annular shoulder aligning with the end face of the inner tube and is formed with a screwthread on that surface facing the annular chamber, and the annular covers are formed on their outer edge with a screwthread corresponding with the screwthread on the annular rim of the outer tube and are screwed into the outer tube with such countersinking that the outer surfaces of the covers are flush with the end faces of the annular rims and the inner surfaces of the covers rest on one hand on the annular shoulders of the outer tube and, on the other hand, on the end faces of the inner tube.

6. A filling according to claim 1, wherein the smoke charge consists of 47.25% of calcined zinc oxide, 47.25% of hexachloroethane and 5.50% of aluminium powder.

7. A filling according to claim 5, wherein, after one annular cover has been screwed into the outer tube, projecting parts of the outer tube are squared off with the screwed-in annular cover.

* * * * *